US009301597B2

(12) United States Patent
Heintschel

(10) Patent No.: US 9,301,597 B2
(45) Date of Patent: Apr. 5, 2016

(54) FOLDABLE HAND TOOL

(71) Applicant: Leo William Heintschel, Oregon, OH (US)

(72) Inventor: Leo William Heintschel, Oregon, OH (US)

( * ) Notice: Subject to any disclaimer, the term of this patent is extended or adjusted under 35 U.S.C. 154(b) by 158 days.

(21) Appl. No.: 14/177,797

(22) Filed: Feb. 11, 2014

(65) Prior Publication Data

US 2015/0223592 A1 Aug. 13, 2015

(51) Int. Cl.
*A46B 9/02* (2006.01)
*A46B 5/00* (2006.01)

(52) U.S. Cl.
CPC ..... *A46B 5/005* (2013.01); *A46B 5/0045* (2013.01); *A46B 2200/302* (2013.01)

(58) Field of Classification Search
CPC ..... A46B 5/005; A46B 5/0045; A46B 2200/302; B25G 3/00; B25G 3/36; B25G 3/38
USPC ..... 15/111, 145, 146, 144.1, 172; 16/422, 16/900
See application file for complete search history.

(56) References Cited

U.S. PATENT DOCUMENTS 1,416,081 A * 5/1922 White ..... A46B 17/02 15/144.1
1,689,109 A 10/1928 Brock
1,754,767 A * 4/1930 Potter ..... B25G 3/36 15/146
2,173,437 A * 9/1939 Kataja ..... B25G 3/38 15/144.1
2,264,736 A * 12/1941 Baker ..... A47L 13/24 15/147.2
2,538,654 A * 1/1951 Petersen ..... B25G 3/00 15/146
2,641,513 A * 6/1953 Fryda ..... B25G 3/38 15/144.1

(Continued)

FOREIGN PATENT DOCUMENTS

CN 202211657 U 5/2012
GB 495729 A 11/1938

*Primary Examiner* — Michael Jennings
(74) *Attorney, Agent, or Firm* — MacMillan, Sobanski & Todd, LLC

(57) ABSTRACT

A hand tool assembly, such as a push broom, includes an elongated work head defining a width and having a slot formed therein extending in a direction along the width. A handle includes an end portion slidably mounted in the slot such that the end portion is movable between a first position and a second position. A fastening mechanism releasably secures the end portion of the handle to the work head when the end portion is in the first position.

9 Claims, 2 Drawing Sheets

(56) References Cited

U.S. PATENT DOCUMENTS 3,506,996 A * 4/1970 Brennan ..... A46B 7/06 15/144.1
3,537,123 A * 11/1970 Leland ..... A47L 13/29 15/121
3,713,184 A * 1/1973 Leland ..... A47L 13/255 15/144.1
3,795,933 A * 3/1974 Seufert ..... A47L 13/12 15/114
4,239,413 A * 12/1980 Wludyka ..... B25G 3/12 15/144.1
4,763,378 A * 8/1988 Drumm ..... A46B 7/04 15/146
4,831,678 A * 5/1989 Dietsche ..... B25G 3/08 15/106
4,850,075 A * 7/1989 Kresse ..... A47L 13/24 15/143.1
4,908,901 A * 3/1990 Torres ..... A47L 13/144 15/119.1
5,309,654 A * 5/1994 Mathis ..... E01H 5/12 15/111
5,502,862 A * 4/1996 Vosbikian ..... A46B 5/0095 15/145
5,568,668 A * 10/1996 Margolin ..... B25G 3/26 15/143.1
6,256,829 B1 * 7/2001 Hatch ..... A46B 5/0033 15/144.1
6,427,289 B2 * 8/2002 Flanz ..... B25G 3/00 15/143.1
6,434,777 B1 * 8/2002 Sutton ..... A46B 7/04 15/114
6,990,705 B1 * 1/2006 Schouten ..... A47L 13/12 15/105
7,155,770 B2 1/2007 Anderson et al.
7,600,287 B1 * 10/2009 Moore ..... A46B 5/0033 15/144.1
8,449,682 B2 * 5/2013 Perelli ..... A46B 5/0033 134/42
2001/0010105 A1 * 8/2001 Flanz ..... B25G 3/00 15/145
2007/0000080 A1 * 1/2007 Libman ..... A46B 7/04 15/145
2007/0226930 A1 * 10/2007 Libman ..... A46B 7/04 15/159.1
2008/0052852 A1 * 3/2008 Lin ..... A47L 13/144 15/119.2

* cited by examiner

FOLDABLE HAND TOOL

BACKGROUND OF THE INVENTION

This invention relates in general to manually operated hand tools, such as push brooms. Conventional push brooms typically include an elongated rigid work head having a plurality of coarse stiff bristles extending from the bottom of the work head. A handle is attached to the work head which generally extends at a right angle from the elongated work head. Although the handle is generally connected to the work head at a central or mid-point of the work head, some brooms have handles which are pivotally mounted at a point which is offset from the mid-point. Typically, the handle includes a threaded end portion which is threadably attached to the work head. This connection provides a fixed attachment which may be unscrewed to replace the handle or work head. Alternatively, the handle may be unscrewed from the work head so that the separated handle and broom may be positioned together in a parallel arrangement and stored in a more efficient manner than when attached to one another. However, this arrangement has the disadvantage of having to reassemble the broom assembly for every use and possibly misplacing or losing one of parts. To prevent this, some brooms include handles having end portions which are pivotally attached to the work head so that they can be pivoted between a use position and storage position such that the handle and work head are parallel with one another and still attached to one another. However, this arrangement provides for a relatively long overall length when the broom is pivoted to its storage position.

SUMMARY OF THE INVENTION

This invention relates to a hand tool assembly, such as a push broom, including an elongated work head defining a width and having a slot formed therein extending in a direction along the width. A handle includes an end portion slidably mounted in the slot such that the end portion is movable between a first position and a second position. A fastening mechanism releasably secures the end portion of the handle to the work head when the end portion is in the first position.

In another embodiment, the invention relates to a handle attachment assembly for a hand tool including an elongated bracket defining a width and having a slot formed therein extending in a direction along the width. The bracket is configured for attachment to a hand tool. A handle includes an end portion slidably mounted in the slot such that the end portion is movable between a first position and a second position. A fastening mechanism releasably secures the end portion of the handle to the work head when the end portion is in the first position.

In yet another embodiment, the invention relates to a hand tool assembly including an elongated work head defining a width and a mid-point generally equidistant from ends of the work head. The work head includes a first attachment point adjacent the mid-point, and a second attachment point spaced from the mid-point. A handle includes an end portion. A brace has a first end pivotally attached to the handle, and a second end pivotally attached to the work head. A fastening mechanism releasably secures the end portion of the handle to either the first attachment point or the second attachment point such that when the end portion of the handle is secured at the first attachment point, the handle is generally perpendicular to the work head, and wherein when the end portion of the handle is secured at the second attachment point, the handle is generally parallel to the work head.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figures 1, 2:
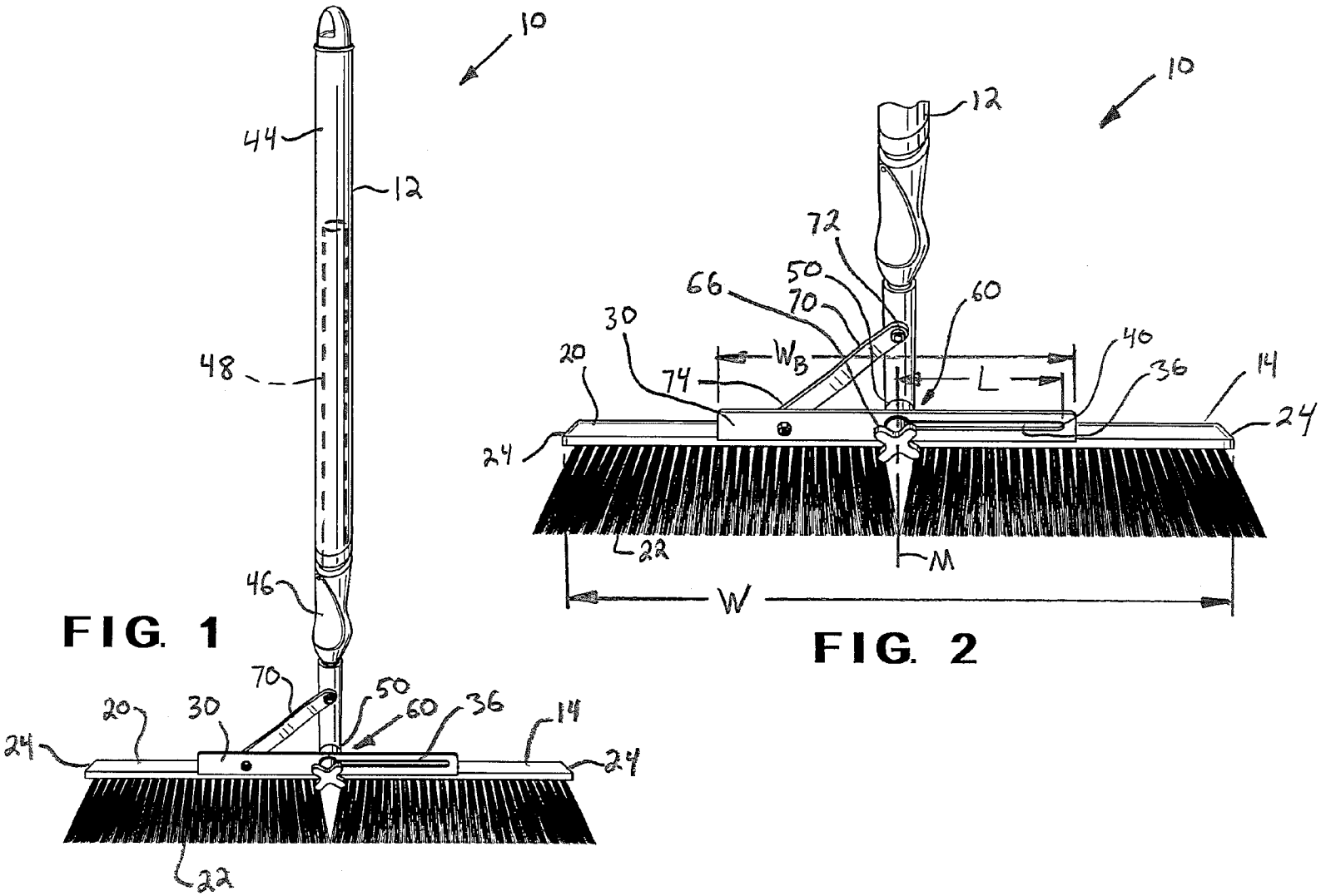
FIG. 1 is a perspective view of a broom assembly.
FIG. 2 is an enlarged perspective view of the work head of the broom assembly of FIG. 1, wherein the broom assembly is shown in a use position.
Figure 4:
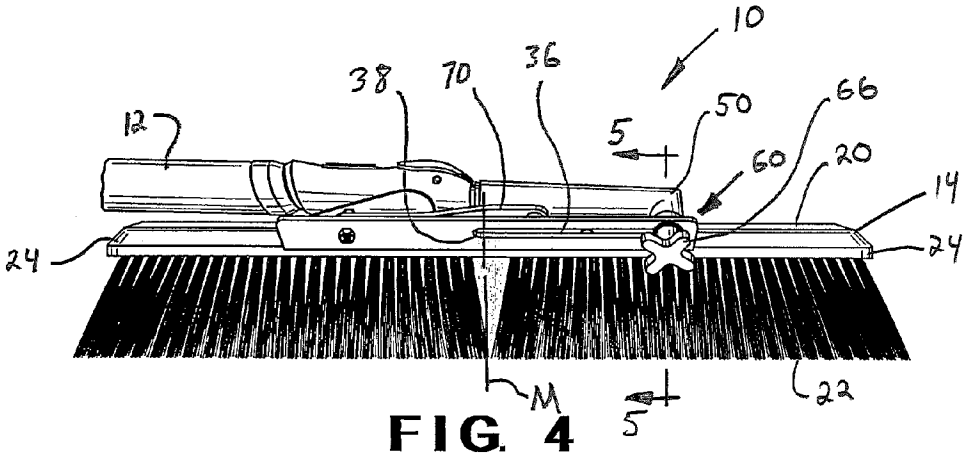
FIG. 4 is a perspective view of the broom assembly of FIG. 2, wherein the broom assembly is shown in a storage position.

Referring now to the drawings, there is illustrated in FIG. 1 a hand tool assembly in the form of a broom assembly, indicated generally at 10. The broom assembly 10 includes a handle 12 and a work head 14. As will be explained below, the handle 12 is movable between a use position, as shown in FIGS. 1 and 2, and a storage position, as shown in FIG. 4, relative to the work head 14.

In the illustrated embodiment, the work head 14 includes a body 20 having a plurality of bristles 22 extending downwardly from the body 20, thereby forming a push style broom. It should be understood that the work head 14 may be formed as other hand operated tools not including the bristles 22. Examples of suitable arrangements for the work head 14 include configurations of squeegees, mops, rakes, hoes, shovels, and scrapers. Thus, it should be understood that the invention is not necessarily limited to a work head 14 having bristles 22. The body 20 may be made of any suitable material such as wood, plastic, or metal.

As shown in FIG. 2, the body 20 of the work head 14 is generally elongated and defines a width W having a mid-point, indicated by a transverse axis M in the figures. The mid-point M is located centrally between ends 24 of the body 20 such that the ends 24 are approximately equally spaced apart from the mid-point M. As will be discussed below, the handle 12 is attached to the body 20 at the mid-point M when in its use position which is usually ideal for operation of a push broom type hand tool.

Figure 3:
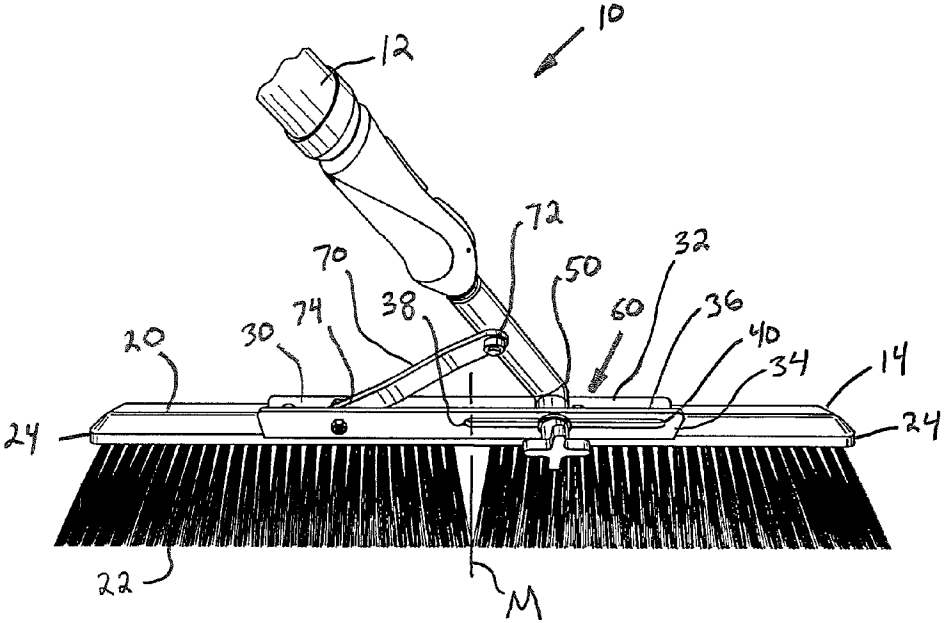
FIG. 3 is a perspective view of the broom assembly of FIG. 2, wherein the broom assembly is shown in an intermediate position.

The broom assembly 10 further includes an elongated bracket 30 which is fixedly attached to the body 20. The bracket 30 may be made of any suitable material, such as metal, wood, or plastic. The elongated bracket 30 defines a width $W_B$. The bracket 30 is attached to the body 20 such that they are generally parallel to one another. As best shown in FIG. 3, the illustrated bracket 30 has an L-shaped cross-section. The bracket 30 has a bottom portion 32 attached to the body 20. A upper portion 34 extends upwardly away from the body 20. The bottom portion 32 can be attached to the body 20 by any suitable manner such as by fasteners, adhesives, or welding. As best shown in FIG. 3, the upper portion 34 includes a slot 36 formed therein having a first end 38 and a second end 40 and having a length L. The first end 38 of the slot 36 is generally positioned adjacent the mid-point M of the body. The second end 40 of the slot 36 is spaced apart from the mid-point M toward one of the ends 24 of the body 20. Although the broom assembly 10, as shown in FIGS. 1-4, includes a separate body 20 and bracket 30, the bracket 30 may be formed integrally with the body 20 such that the body 20 is configured to include the slot 36. Thus, a separate bracket 30 may be eliminated. The use of a separate bracket 30 may be useful for attaching the bracket 30 to a pre-manufactured work head 14 such that the broom assembly 10 may be sold as a kit without the work head 14 so that the buyer can attach the bracket 30 to any suitable work head sold separately.

As shown in FIG. 1, the handle 12 of the broom assembly 10 is elongated and is held by the user during operation of the broom assembly 10. The handle 12 can have any suitable shape, such as cylindrical or contoured. The handle 12 may have a fixed length or may be made of multiple sections that are preferably telescopically mounted to one another so that the overall length of the handle 12 can be reduced and collapsed for storage. For example, the handle 12 can include a first portion 44 and a second portion 46. The second portion 46 may include an extension 48 which is telescopically mounted within the first portion 44. Alternatively, the handle 12 may include three or more telescopically arranged portions to further reduce the overall length when collapsed.

Figure 5:
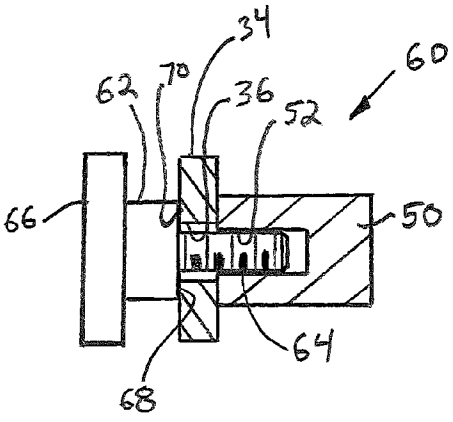
FIG. 5 is a cross-sectional view taken along lines 5-5 of FIG. 4.

Referring to FIGS. 4 and 5, the handle 12 further includes an end portion 50. The end portion 50 includes a threaded bore 52 formed therein. The broom assembly 10 includes a fastening mechanism in the form of a clamping mechanism, indicated generally at 60. The clamping mechanism 60 includes a hand knob 62 having a threaded stud 64 received in the threaded bore 52 of the end portion 50 of the handle 12. The threaded stud 64 extends through the slot 36 of the bracket 30 such that the bracket 30 is sandwiched between the knob 62 and the end portion 50 of the handle 12. The knob 62 can include a handle portion 66 for assisting in turning the knob 62 by manual operation. The knob 62 includes a shoulder 68 which abuts a surface 70 of the upper portion 34 of the bracket 30. Alternatively, the clamping mechanism 60 could be configured such that a threaded stud is mounted on the end portion 50 which engages with a threaded bore formed in the knob 62. It should be understood that the illustrated clamping mechanism 60 is only one example of a suitable fastening mechanism and that any suitable fastener may be used to releasably secure the end portion 50 of the handle 12 to the bracket 30.

The broom assembly 10 further includes a brace 70. The brace 70 can be in the form or an elongated rod or link member and can be made of any suitable material, such as metal, plastic, or wood. The brace 70 includes a first end 72 pivotally attached to the handle 12 and a second end 74 pivotally attached to the bracket 30.

The broom assembly 10 is shown in FIGS. 1 and 2 in its use position. In this position, the handle 12 is generally perpendicular to the of the work body 20. The threaded stud 64 of the clamping mechanism 60 is positioned at the first end 38 of the slot 36 such that the end portion 50 of the handle 12 is aligned with the mid-point M of the body 20. The brace 70 is sized so as to help support the handle 12 when in the use position. In the use position, the clamping mechanism 60 is in a clamped position such that the position of the end portion 50 of the handle 12 is fixed relative to the bracket 30. In the clamped position, the knob 62 is rotated to squeeze or clamp the bracket 30 between the shoulder 68 of the knob 62 and the end portion 50 of the handle 12 such that frictional forces maintain this position. If desired, the clamping mechanism 60 may further include washers, Belleville springs, or bushings (not shown). Note that although the slot 36 could be made longer such that the first end 38 does not line up with the mid-point M of the body 20, it is preferred to be positioned at the mid-point M so that the user of the broom assembly 10 can quickly position the end portion 50 of the handle 12 to this use position.

To place the broom assembly 10 in its storage position, the clamping mechanism 60 is first released to an unclamped position. To accomplish this, the knob 62 is rotated in the opposite direction such that the stud 64 is moved slightly in an axial direction out from the threaded bore 52, thereby releasing the frictional grip between the shoulder 68, the bracket 30, and the end portion 50. The end portion 50 of the handle 12 can then be moved towards the end of the bracket 30 such that the threaded stud 64 slides within slot 36 from the first end 38 toward the second end 40. FIG. 3 illustrates this intermediate position when the broom assembly 10 is between its use and storage position. Sliding the end portion 50 and the threaded stud 64 a sufficient distance toward the second end 40 of the slot 36, as shown in FIG. 4, will place the broom assembly 10 in its storage position such that the handle 12 is generally parallel with the body 20. If desired, the clamping mechanism 60 may then be engaged to its clamped position to secure the handle 12 in this parallel storage position. During movement between the use and storage positions, the brace 70 assists in sliding the end portion 50 towards or away from the mid-point M. Note that the brace 70 may be eliminated such that the clamping mechanism 60 is operated once the handle 12 is manually aligned in the perpendicular arrangement relative to the body 20.

The advantage of the configuration of the broom assembly 10 is that when the broom assembly 10 is placed in the storage position, the end portion 50 of the handle 12 is moved away from the mid-point M of the work head 14 so that the overall folded length of the handle 12 and the work heads 14 is reduced compared to a conventional foldable broom assembly. In a conventional foldable broom assembly, the end of the handle is pivotally fixed at the mid-point of the body of the work head and the handle is simply pivoted to a parallel position with the body. If desired, the width $W_B$ of the bracket 30 and the slot 36 can be increased to further reduce the length of the folded broom assembly 10 in its storage position. Note that if the slot 36 was configured to extend between the mid-point M and a position adjacent the end 24 of the body 20, the reduced overall folded length of the broom assembly 10 would be optimized but may require additional material and added weight to the broom assembly 10.

Another advantage of the configuration of the broom assembly 10 is that the handle 12 may be secured by the clamping mechanism 60 to position the handle 12 at any angle relative to the body 20, such as shown in FIG. 3. Positioning the broom assembly 10 in any of these intermediate positions may be useful, for example, for using the work head 14 against a vertical wall in which it is desired to orient the work head 12 in a vertical direction.

Although the slot 36 is shown and described as being continuous between the ends 38 and 40, the bracket 30 could be configured such that the first and second ends 38 and 40 define separate holes functioning as two attachment points for the clamping mechanism 60. In this configuration, the end portion 50 of the handle 12 and the threaded stud 64 of the knob 62 can be removed from one of the attachment points and positioned to the other attachment point to move the broom assembly between its use and storage positions. The clamping mechanism 60 can then be tightened in each position to secure the handle 12 to the work head 14.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A hand tool assembly comprising:

a bracket adapted to support a work head and including first and second ends defining a mid-point that is generally equidistant from the first and second ends, the bracket having a slot including a first end that is positioned generally adjacent to the midpoint of the bracket and second end spaced apart from the mid-point;

a handle including an end portion that cooperates with the slot for sliding movement relative to the bracket;

a brace including a first end that is pivotally attached to the bracket and a second end that is pivotally attached to the handle such that the handle is movable relative to the bracket between a first position, wherein the bracket is generally perpendicular to the handle, and a second position, wherein the bracket is generally parallel to the handle; and a fastening mechanism that selectively permits and prevents the bracket from moving relative to the handle.

2. The hand tool assembly defined in claim 1 further including a work head that is secured to the bracket.

3. The hand tool assembly defined in claim 2 wherein the work head is a broom.

4. The hand tool assembly defined in claim 1 further including a work head that is formed integrally with the bracket.

5. The hand tool assembly defined in claim 4 wherein the work head is a broom.

6. The hand tool assembly defined in claim 1 wherein the end portion of the handle is positioned generally adjacent to the first end of the slot when the bracket is located in the first position relative to the handle.

7. The hand tool assembly defined in claim 6 wherein the end portion of the handle is positioned generally adjacent to the second end of the slot when the bracket is located in the second position relative to the handle.

8. The hand tool assembly defined in claim 1 wherein the fastening mechanism selectively causes frictional engagement of the bracket and the handle to prevent the bracket from moving relative to the handle.

9. The hand tool assembly defined in claim 1 wherein the fastening mechanism includes a knob having a threaded stud that is received in a threaded bore provided in the end portion of the handle.

* * * * *